US010604391B2

(12) United States Patent
Yahner et al.

(10) Patent No.: US 10,604,391 B2
(45) Date of Patent: Mar. 31, 2020

(54) SYSTEMS AND METHODS FOR MAST STABILIZATION ON A MATERIAL HANDLING VEHICLE

(71) Applicant: The Raymond Corporation, Greene, NY (US)

(72) Inventors: Joseph Thomas Yahner, Chenango Forks, NY (US); Eric Albert Smith, Sidney Center, NY (US)

(73) Assignee: The Raymond Corporation, Greene, NY (US)

( * ) Notice: Subject to any disclaimer, the term of this patent is extended or adjusted under 35 U.S.C. 154(b) by 84 days.

(21) Appl. No.: 15/934,011

(22) Filed: Mar. 23, 2018

(65) Prior Publication Data

US 2018/0273364 A1 Sep. 27, 2018

Related U.S. Application Data

(60) Provisional application No. 62/475,590, filed on Mar. 23, 2017.

(51) Int. Cl.
*B66F 9/22* (2006.01)
*B66F 7/20* (2006.01)
(Continued)

(52) U.S. Cl.
CPC ..... *B66F 9/22* (2013.01); *B66F 7/20* (2013.01); *B66F 9/07559* (2013.01); *B66F 9/08* (2013.01); *E02F 9/2207* (2013.01)

(58) Field of Classification Search
CPC ..... B66F 9/07559; B66F 9/08; B66F 9/20; B66F 9/205; B66F 9/22; B66F 17/003; B66F 7/20; B66F 9/142; B66F 9/143; B66F 9/144; B66F 9/145; F15B 11/16; F15B 13/06; E02F 9/2207; E02F 9/2217
See application file for complete search history.

(56) References Cited

U.S. PATENT DOCUMENTS 4,232,588 A * 11/1980 Ziplies ..... F15B 20/005 60/406
4,286,432 A * 9/1981 Burrows ..... F15B 13/01 60/404
(Continued)

FOREIGN PATENT DOCUMENTS

CN 202465129 U * 10/2012
CN 203959756 U * 11/2014
(Continued)

OTHER PUBLICATIONS

EPO machine translation of EP 1193211 (original EP document published Apr. 3, 2002) (Year: 2002).*
(Continued)

*Primary Examiner* — Faris S Almatrahi
*Assistant Examiner* — David A Testardi
(74) *Attorney, Agent, or Firm* — Quarles & Brady LLP

(57) ABSTRACT

Systems and methods for mast stabilization on a material handling vehicle are provided. In one aspect, the present disclosure provides systems and methods for a hydraulic circuit configured to stabilize a mast of a material handling vehicle in dynamic and static events. The hydraulic circuit is integrated into a typical hydraulic system used to raise and lower the mast and thereby a load supported by the mast.

12 Claims, 5 Drawing Sheets

(51) Int. Cl.

| | |
|---|---|
| ***E02F 9/22*** | (2006.01) |
| ***B66F 9/075*** | (2006.01) |
| ***B66F 9/08*** | (2006.01) |

(56) References Cited

U.S. PATENT DOCUMENTS

| | | | | |
|---|---|---|---|---|
| 4,483,409 | A * | 11/1984 | Fun | B62D 33/067 180/89.15 |
| 4,763,800 | A | 8/1988 | Engler et al. | |
| 5,184,699 | A | 2/1993 | Aoki et al. | |
| 5,292,220 | A * | 3/1994 | Cartner | E02F 3/627 414/687 |
| 5,329,441 | A | 7/1994 | Aoki et al. | |
| 5,505,043 | A * | 4/1996 | Baginski | B66F 9/20 60/477 |
| 6,125,970 | A | 10/2000 | Takeuchi et al. | |
| 6,189,432 | B1 * | 2/2001 | Colarelli | B66F 7/20 91/171 |
| 6,293,099 | B1 * | 9/2001 | Kamiya | B66F 9/22 60/421 |
| 6,351,944 | B1 * | 3/2002 | Fertig | E02F 9/2207 60/413 |
| 6,370,874 | B1 * | 4/2002 | Rausch | E02F 9/2207 60/413 |
| 9,771,250 | B2 | 9/2017 | Ueda et al. | |
| 2002/0174766 | A1 * | 11/2002 | Norton | B66F 9/22 92/82 |
| 2004/0003589 | A1 * | 1/2004 | Johansson | B66F 9/22 60/327 |
| 2004/0006980 | A1 * | 1/2004 | Berthod | E02F 9/2207 60/413 |
| 2008/0104866 | A1 * | 5/2008 | Karl | E02F 9/2207 37/416 |
| 2009/0256394 | A1 * | 10/2009 | Meier | B62D 33/0617 296/190.08 |
| 2014/0312639 | A1 * | 10/2014 | Petronek | B66F 9/183 294/198 |
| 2016/0297656 | A1 | 10/2016 | Ueda et al. | |

FOREIGN PATENT DOCUMENTS

| | | | | |
|---|---|---|---|---|
| DE | 2500552 | B1 * | 6/1976 | F16K 17/30 |
| DE | 102007059436 | A1 * | 6/2009 | B66F 9/22 |
| EP | 1193211 | A2 * | 4/2002 | B66F 9/22 |
| EP | 1260479 | A2 | 11/2002 | |
| EP | 1369377 | A2 | 12/2003 | |
| EP | 1503121 | A1 * | 2/2005 | F16K 17/30 |
| EP | 1593645 | A2 | 11/2005 | |
| EP | 2354564 | A1 * | 8/2011 | |
| GB | 2108242 | A * | 5/1983 | B66F 9/22 |
| JP | 07004405 | A * | 1/1995 | F15B 11/044 |
| JP | 08026697 | A * | 1/1996 | F15B 11/044 |
| JP | 2002349502 | A * | 12/2002 | B66F 7/20 |
| WO | WO-9511189 | A1 * | 4/1995 | B66F 7/20 |
| WO | 0206679 | A2 | 1/2002 | |

OTHER PUBLICATIONS

Bosch Rexroth, "Proportional pressure relief valve" brochure, Type DBETX, RE 29161/07.05, Jul. 2005, 12 pages. (Year: 2005).*

Hawe Hydraulik SE, "Line rupture protection valves type LB" brochure, D 6990, May 2007, 5 pages. (Year: 2007).*

International Standard ISO 1219-1, (c) ISO 2006, partial copy including Sections 6 to 6.1.8, 40 pages (Year: 2006).*

European Patent Office, Extended European Search Report, Application No. 18163661.4 dated Aug. 17, 2018, 7 pages.

* cited by examiner

SYSTEMS AND METHODS FOR MAST STABILIZATION ON A MATERIAL HANDLING VEHICLE

CROSS-REFERENCES TO RELATED APPLICATIONS

The present application is based on, claims priority to, and incorporates herein by reference in its entirety, U.S. Provisional Patent Application No. 62/475,590, filed on Mar. 23, 2017, and entitled "Systems and Methods for Mast Stabilization on a Material Handling Vehicle."

STATEMENT REGARDING FEDERALLY SPONSORED RESEARCH

Not Applicable.

BACKGROUND

The present invention relates generally to material handling vehicles and, more specifically, to systems and methods for mast stabilization on a material handling vehicle.

Material handling vehicles typically include one or more lift cylinders coupled to a mast to facilitate raising and lowering of a load. The lift cylinders can be supplied with hydraulic fluid (e.g., oil) from a pump. In some configurations, the lift cylinders can be configured to receive fluid from the pump to facilitate extending the mast and fluid may flow from the lift cylinders to retract the mast.

SUMMARY OF THE INVENTION

The present invention provides systems and methods for mast stabilization on a material handling vehicle. In particular, the present disclosure provides systems and methods for a hydraulic circuit configured to stabilize a mast of a material handling vehicle in dynamic and static events. The hydraulic circuit is integrated into a typical hydraulic system used to raise and lower the mast and thereby a load supported by the mast.

In one aspect, the present disclosure provides a hydraulic system for mast stabilization on a material handling vehicle. The material handling vehicle includes a first lift cylinder and a second lift cylinder configured to receive fluid from a pump. The hydraulic system includes a first flow limiting device arranged between the pump and the first lift cylinder, and a second flow limiting device arranged between the pump and the second lift cylinder. The first flow limiting device is configured to restrict fluid flow between the first lift cylinder and the second lift cylinder, and the second flow limiting device is configured to restrict fluid flow between the second lift cylinder and the first flow cylinder.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

DESCRIPTION OF DRAWINGS

The invention will be better understood and features, aspects and advantages other than those set forth above will become apparent when consideration is given to the following detailed description thereof. Such detailed description makes reference to the following drawings

DETAILED DESCRIPTION OF THE INVENTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow.

The use of the term "material handling vehicle" herein is a term that described a vehicle configured to manipulate a load. In some non-limiting examples, a material handling vehicle may comprise an order picker, a reach truck, a swing reach truck, a forklift, a pallet jack, or the like.

Currently, hydraulic systems on material handling vehicles fluidly connect the lift cylinders that are configured to raise and lower a mast. By fluidly connecting the lift cylinders, an input force can alter a stroke position (i.e., a position of a ram received within the lift cylinder and coupled to the mast) and, when one of the lift cylinders reacts to the input force (e.g., by retracting), another lift cylinder fluidly coupled thereto can react in an opposing way (e.g., by extending). Accordingly, it may desirable to have a hydraulic system capable of inhibiting or eliminating this counter-reaction, or cross talk between the two lift cylinders.

Figure 1:
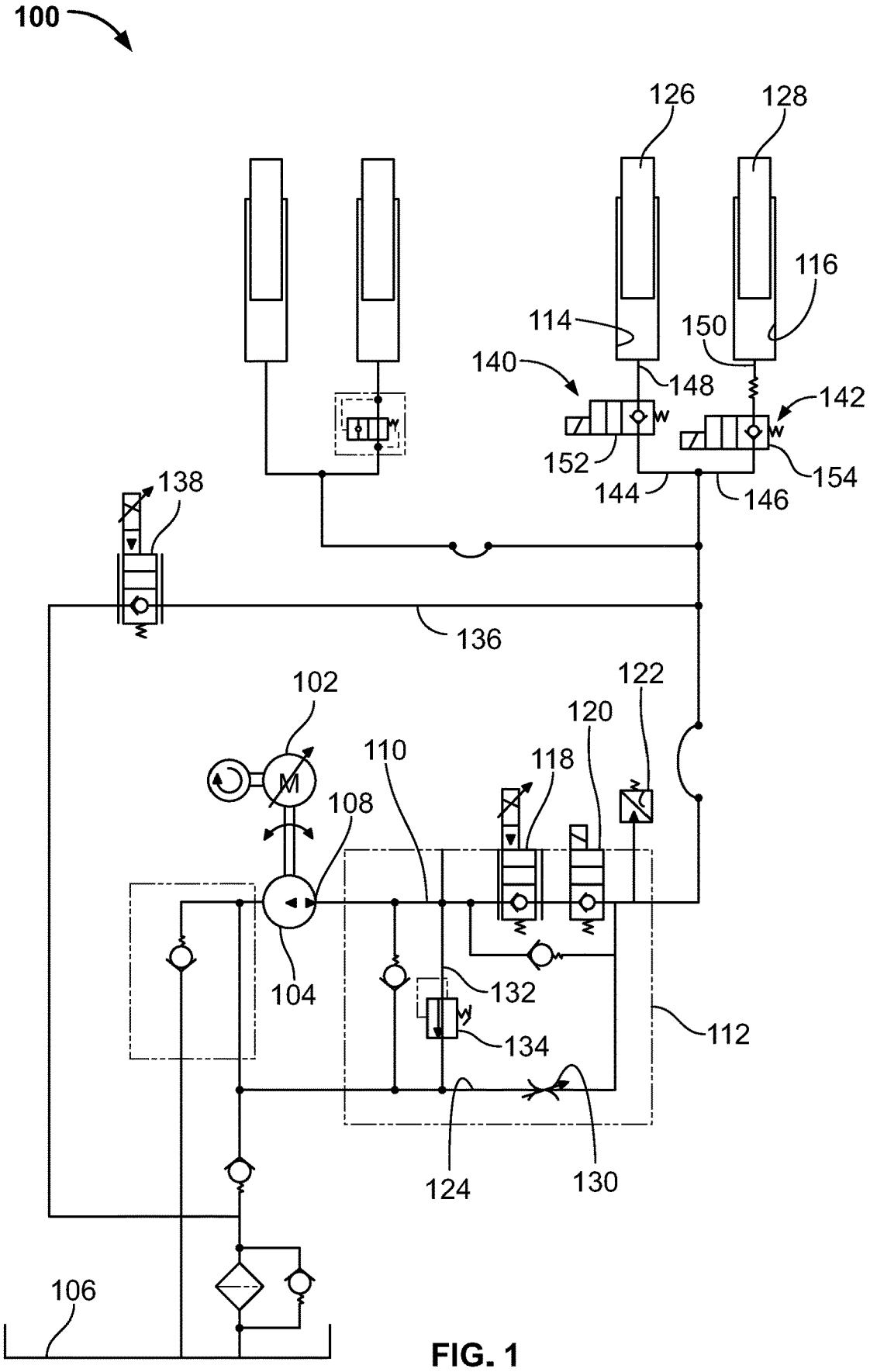
FIG. 1 is a schematic illustration of a hydraulic system including flow limiting valves according to one aspect of the present disclosure.

FIG. 1 illustrates one non-limiting example of a hydraulic system 100 according to the present disclosure. The hydraulic system 100 can include a motor 102, a pump 104, and a reservoir 106. The motor 102 can drive the pump 104 to draw fluid (e.g., oil) from the reservoir 106 and furnish the fluid under increased pressure at a pump outlet 108. The pump outlet 108 can be in fluid communication with a supply passage 110. The supply passage 110 can extend from the pump outlet 108 through a lowering circuit 112 and to a first lift cylinder 114 and a second lift cylinder 116. The lowering circuit 112 can include a first lowering control valve 118, a second lowering control valve 120, and a pressure sensor 122. The second lowering control valve 120 can be arranged between the first lowering control valve 118 and the pressure sensor 122, with the pressure sensor 122 arranged between the second lowering control valve 120 and the first and second lift cylinders 114 and 116. A return passage 124 can provide fluid communication from a location on the supply passage 110 between the second lowering control valve 120 and the pressure sensor 122 to the reservoir 106.

During operation, the motor 102 can drive the pump 104 to supply pressurized fluid to the first lift cylinder 114 and the second lift cylinder 116 to extend the rams 126 and 128 slidably received therein. As is known in the art, the rams 126 and 128 may be coupled to a mast (not shown) of a material handling vehicle (not shown). When the rams 126 and 128 are extended, the mast (not shown) coupled thereto also extends. The pressurized fluid within the first lift cylinder 114 and the second lift cylinder 116 can be selectively allowed to flow out and back to the lowering circuit 112. This can cause the rams 126 and 128 to retract back into their respective lift cylinder 114 and 116. The pressurized fluid flowing from the first lift cylinder 114 and the second lift cylinder 116 during retraction can flow into the return passage 124 and through a variable orifice 130. The variable orifice 130 can be configured to variably build pressure upstream thereof to provide a mechanism for controlled manual lowering of the mast (not shown). Alternatively or additionally, the first lowering control valve 118 and the second lowering control valve 120 can be selectively actuated to enable the pressurized fluid flowing from the first lift cylinder 114 and the second lift cylinder 116 to flow back through the pump 104. The pump 104 can be bi-directional and, when the fluid from the first lift cylinder 114 and the second lift cylinder 116 flows back through the pump 104, the pump 104 can rotate the motor 102 to, for example, charge a battery (not shown) of the material handling vehicle (not shown).

A pressure relief line 132 can provide fluid communication from the supply passage 110 at a location between the pump outlet 108 and the first lowering control valve 118 to the return passage 124 at a location downstream of the variable orifice 130. A pressure relief valve 134 can be arranged on the pressure relief line 132. The pressure relief valve 134 can be biased into a first position where fluid communication is inhibited across the pressure relief valve 134 from the supply passage 110 to the return passage 124. The pressure relief valve 134 can be biased into a second position when a pressure upstream of the pressure relief valve 134 is greater than a predetermined pressure relief threshold. In the second position, the pressure relief valve 134 can provide fluid communication from the supply passage 110 to the return passage 124, thereby relieving the pressure applied to the components of the hydraulic system 100.

A bypass line 136 can provide fluid communication from a location on the supply passage 110 between the pressure sensor 122 and the first and second lift cylinders 114 and 116 to the return passage 124 and thereby to the reservoir 106. The bypass line 136 can include a bypass control valve 138 arranged thereon. The bypass control valve 138 can be moveable between a first position where fluid communication is inhibited in a direction from the first and second lift cylinders 114 and 116 to the return passage 124, and a second position where fluid communication is provided along the bypass line 136 from the first and second lift cylinders 114 and 116 to the return passage 124. When the bypass control valve 138 displaces toward the second position, the bypass line 136 can isolate the first and second lift cylinders 114 and 116 from the lowering circuit 112 and provide a fluid path to the reservoir 106 that bypasses the lowering circuit 112. In some non-limiting examples, the bypass control valve 138 can be variably moveable between the first position and the second position.

A first flow limiting device 140 can be configured to isolate the first lift cylinder 114 from the lowering circuit 112 and to selectively inhibit fluid communication from the first lift cylinder 114 to the second lift cylinder 116. A second flow limiting device 142 can be configured to isolate the second lift cylinder 116 from the lowering circuit 112 and to selectively inhibit fluid communication from the second lift cylinder 116 to the first lift cylinder 114. The use of the term "flow limiting device" herein is a term that relates any device capable of limiting a fluid flow rate (mass or volume based) or selectively limiting a direction of fluid flow.

The supply passage 110 can split into a first supply line 144 and the second supply line 146. The first supply line 144 can be in fluid communication with an inlet 148 of the first lift cylinder 114. The second supply line 146 can be in fluid communication with an inlet 150 of the second lift cylinder 116. The first flow limiting device 140 can be arranged on the first supply line 144. In the illustrated non-limiting example of FIG. 1, the first flow limiting device 140 can be in the form of a first control valve 152. The first control valve 152 can be moveable between a first position where fluid communication can only be allowed to flow in a direction from the pump 104 to the inlet 148 of the first lift cylinder 114, and a second position where fluid communication can be provided in either direction between the inlet 148 of the first lift cylinder 114 and the pump 104 and/or the reservoir 106. Similarly, the second flow limiting device 142 can be in the form of a second control valve 154. The second control valve 154 can be moveable between a first position where fluid communication can only be allowed to flow in a direction from the pump 104 to the inlet 150 of the second lift cylinder 116, and a second position where fluid communication can be provided in either direction between the inlet 150 of the second lift cylinder 116 and the pump 104 and/or the reservoir 106.

In operation, the first control valve 152 and the second control valve 154 can enable the hydraulic system 100 to selectively isolate the first lift cylinder 114 and the second lift cylinder 116 from one another. In some non-limiting examples, the first control valve 152 and/or the second control valve 154 may be selectively moved between the first and second positions thereof based on a pressure in at least one of the first lift cylinder 114 and the second lift cylinder 116. For example, an increase or decrease in pressure in at least one of the first lift cylinder 114 and the second lift cylinder 116 may signify that the first lift cylinder 114 and the second lift cylinder 116 need to be isolated from one another for a predetermined amount of time. This functionality of the hydraulic system 100 can selectively prevent fluid cross talk between the first lift cylinder 114 and the second lift cylinder 116. That is, pressure fluctuations due to displacement of one of the rams 126 and 128 in one of the first and second lift cylinders 114 and 116 can be prevented from transferring to the other of the first and second lift cylinders 114 and 116 and displacing the other ram 126 and 128 in an opposite direction to increase mast stabilization. In this way, the hydraulic system 100 can provide enhanced mast stability by selectively isolating the first lift cylinder 114 and the second lift cylinder 116 from one another.

Figure 2:
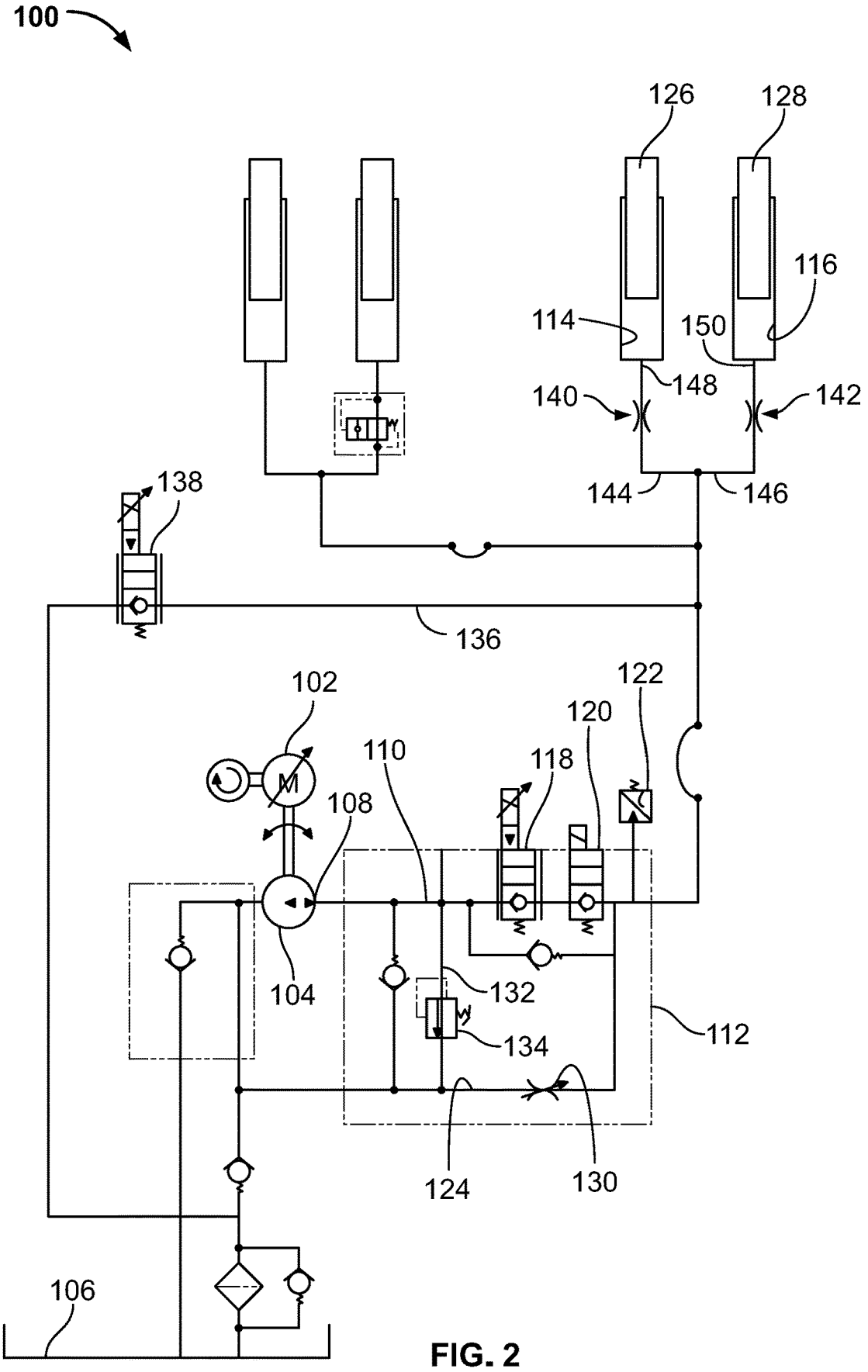
FIG. 2 is a schematic illustration of a hydraulic system including flow limiting orifices according to one aspect of the present disclosure.
Figure 3:
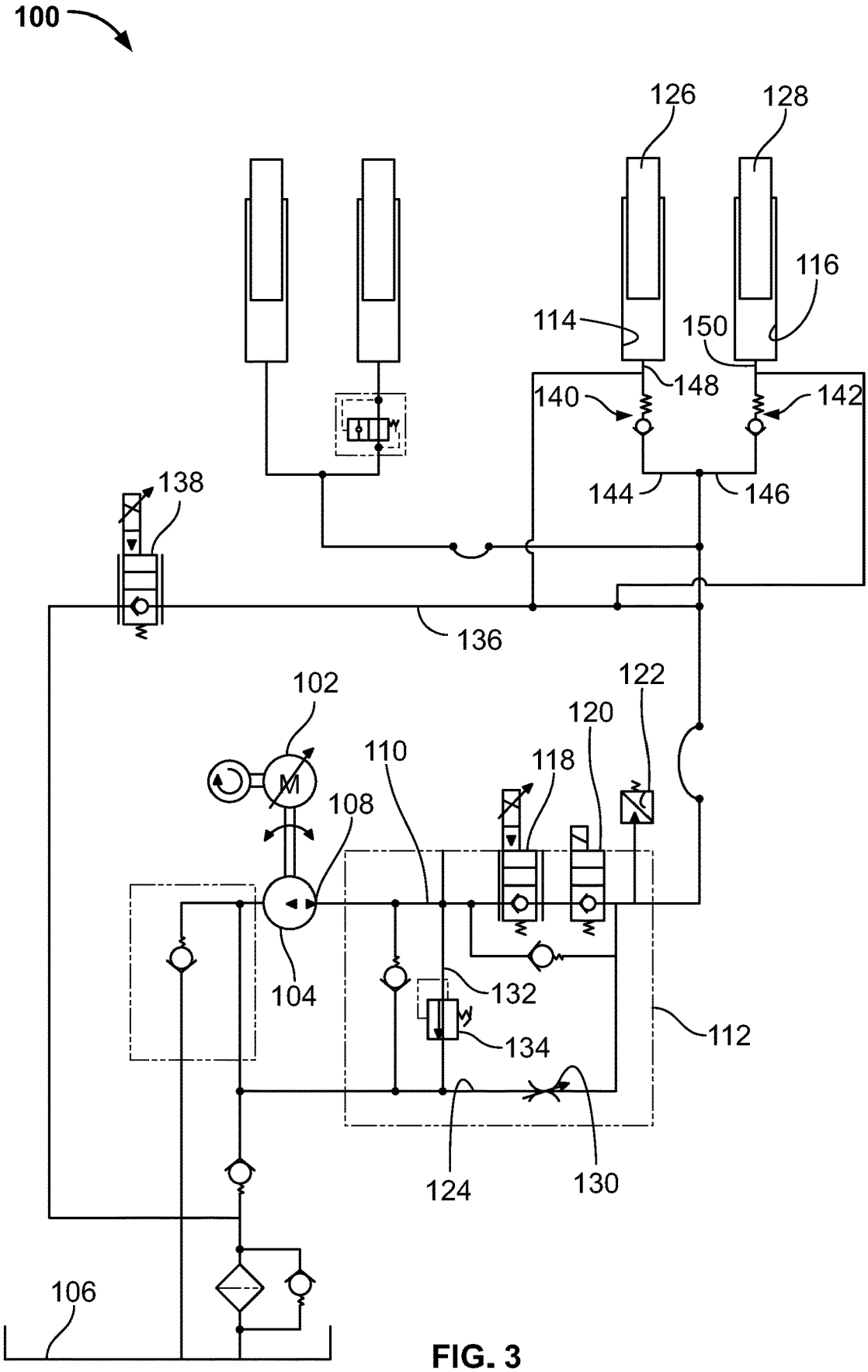
FIG. 3 is a schematic illustration of a hydraulic system including flow limiting check valves according to one aspect of the present disclosure.
Figure 4:
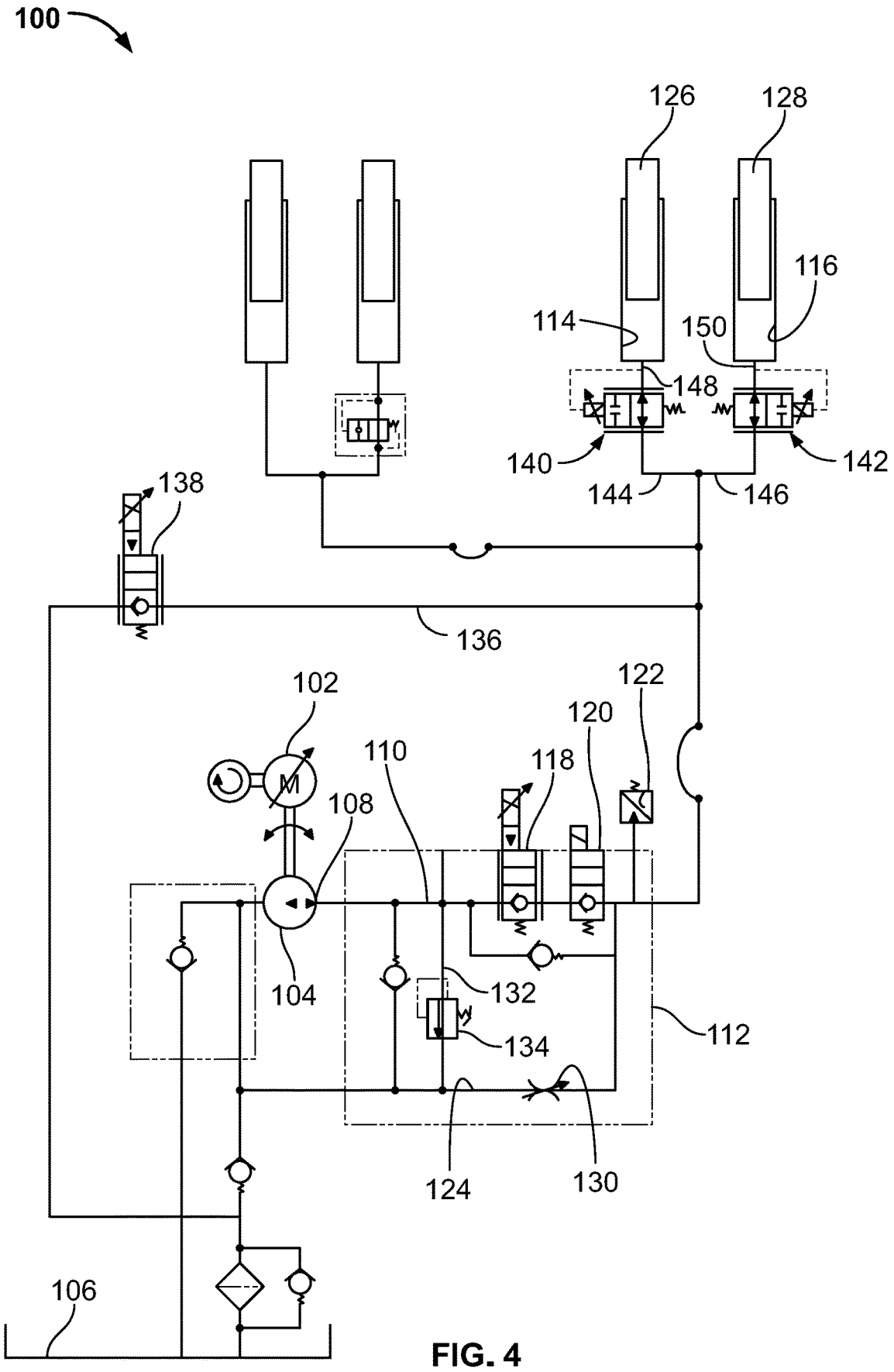
FIG. 4 is a schematic illustration of a hydraulic system including flow limiting proportional valves according to one aspect of the present disclosure.

It should be appreciated that the first control valve 152 and the second control valve 154 are but one non-limiting example of the first flow limiting device 140 and the second flow limiting device 142. In some non-limiting examples, the first flow limiting device 140 and the second flow limiting device 142 may be in the form of an orifice (see, e.g., FIG. 2). In some non-limiting examples, the first flow limiting device 140 and the second flow limiting device 142 may be in the form of a check valve (see, e.g., FIG. 3). In some non-limiting examples, the first flow limiting device 140 and the second flow limiting device 142 may be in the form of a proportional valve that is actively opened and closed based on pressure fluctuations in the first lift cylinder 114 and the second lift cylinder 116 (see, e.g., FIG. 4). As illustrated in FIG. 4, each of the proportional valves may include a proportional solenoid that is selectively movable between infinite positions in response to a pressure between the respective lift cylinder and the proportional valve (e.g., a pressure within the respective lift cylinder).

Figure 5:
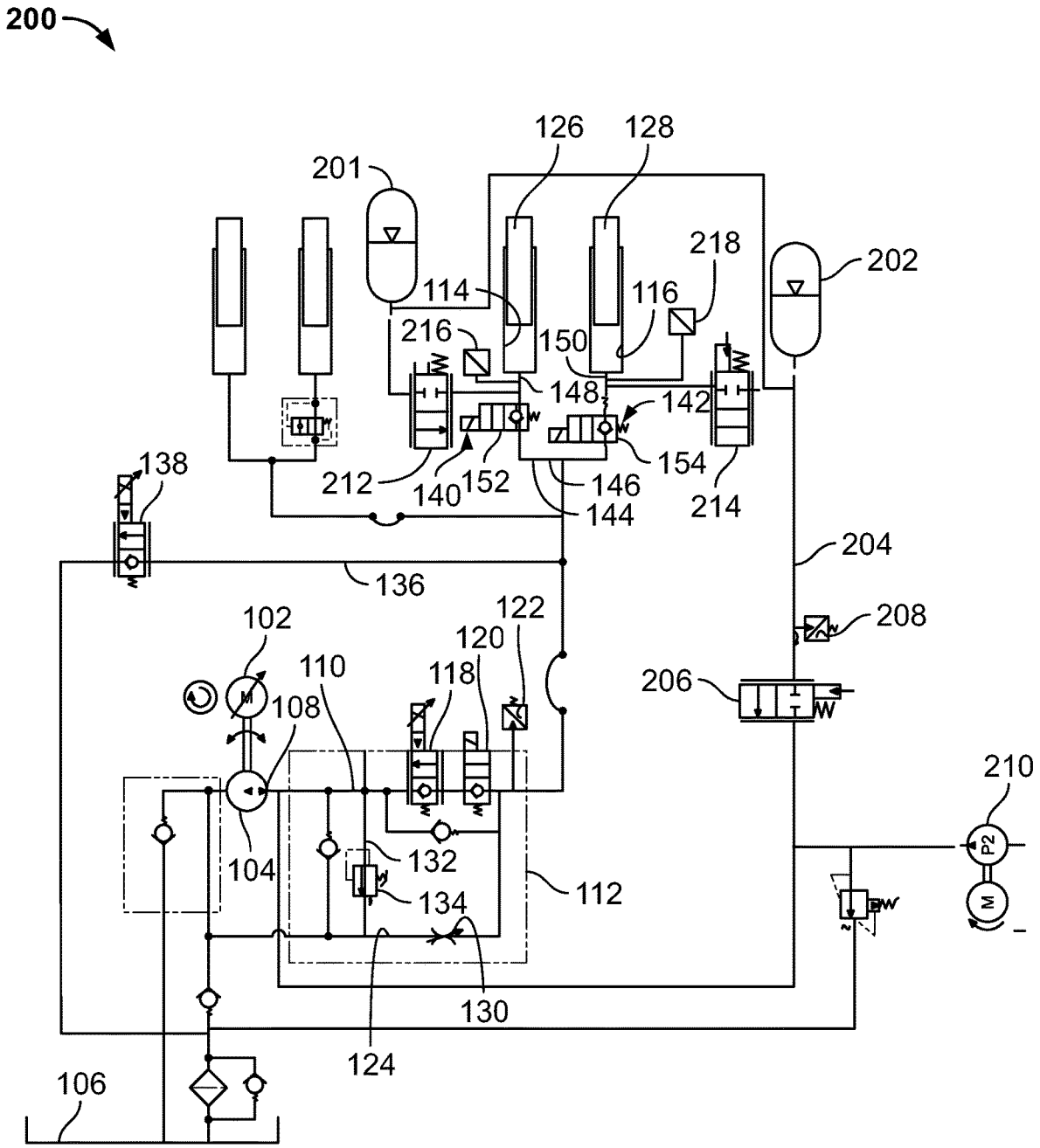
FIG. 5 is a schematic illustration of a hydraulic system having accumulators according to one aspect of the present disclosure.

FIG. 5 illustrates another non-limiting example of a hydraulic system 200 according to the present disclosure. The hydraulic system 200 can be similar to the hydraulic system 100 except as described below or is apparent from the figures. Similar components are identified using like reference numerals. As shown in FIG. 5, the hydraulic system 200 can include a first accumulator 201 and a second accumulator 202. The first accumulator 201 and the second accumulator 202 can be in fluid communication with the pump outlet 108 via a charge line 204. A charge control valve 206 can be arranged on the charge line 204 upstream of the first accumulator 201 and the second accumulator 202. The charge control valve 206 can be moveable between a first position where fluid communication is inhibited between the pump outlet 108 and the first and second accumulators 201 and 202, and a second position where fluid communication is provided between the pump outlet 108 and the first and second accumulators 201 and 202. An accumulator pressure sensor 208 can be arranged on the charge line downstream of the charge control valve 206. The accumulator pressure sensor 208 can sense the pressure within the first and second accumulators 201 and 202.

The first and second accumulators 201 and 202 can be charged (i.e., increase the pressure within the accumulators) by the selective actuation of the charge control valve 206. The accumulator pressure sensor 208 can sense the pressure within the first and second accumulators 201 and 202 and, when the pressure within the first and second accumulators 201 and 202 decreases below a predetermined value, the charge control valve 206 can actuate to the second position to provide pressurized fluid from the pump outlet 108 to the first and second accumulators 201 and 202. In some non-limiting examples, the first and second accumulators 201 and 202 can be charged to a predetermined pressure that is above the working pressure within the first and second lift cylinders 114 and 116 and less than or equal to the relief pressure set by the pressure relief valve 134. The pressure sensed by the accumulator pressure sensor 208 can provide feedback to a controller (not shown), which can control the actuation of the charge control valve 206 based on the sensed pressure.

The charging of the first and second accumulators 201 and 202 can be controlled via multiple input criteria (e.g., accumulator pressure, carriage position, handle request, etc.). This can enable the hydraulic system 200 to be configurable to choose an optimum time to charge the first and second accumulators 201 and 202 and still provide regenerative flow to the pump 104. For example, when the rams 126 and 128 retract within the first and second lift cylinders 114 and 116 (i.e., the mast can be lowering), the bypass control valve 138 can be actuated to the second position to enable the pump 104 to charge the first and second accumulators 201 and 202. Alternatively or additionally, an auxiliary pump 210 may be integrated into the hydraulic system 200 to charge the first and second accumulators 201 and 202. The auxiliary pump 210 can be in fluid communication with the charge line 204 upstream of the charge control valve 206. In one non-limiting example, the pump 104 and/or the auxiliary pump 210 can be configured to charge the first and second accumulators 201 and 202 at a desired time until the pressure relief valve 134 is biased into the second position.

The first accumulator 201 can be selectively placed in fluid communication with the first supply line 144 at a location between the first flow limiting device 140 and the inlet 148 of the first lift cylinder 114 via a first accumulator control valve 212. The first accumulator control valve 212 can be moveable between a first position where fluid communication is inhibited between the first accumulator 201 and the first lift cylinder 114, and a second position where fluid communication is provided between the first accumulator 201 and the first lift cylinder 114. Similarly, the second accumulator 202 can be selectively placed in fluid communication with the second supply line 146 at a location between the second flow limiting device 142 and the inlet 150 of the second lift cylinder 116 via a second accumulator control valve 214. The second accumulator control valve 214 can be moveable between a first position where fluid communication is inhibited between the second accumulator 202 and the second lift cylinder 116, and a second position where fluid communication is provided between the second accumulator 202 and the second lift cylinder 116.

As described above, the first and second accumulators 201 and 202 can be charged to a pressure above the working pressure of the first and second lift cylinders 114 and 116. In this way, when the first accumulator control valve 212 and/or the second accumulator control valve 214 actuate to the second position, the respective one of the first and second accumulators 201 and 202 can increase the pressure within the respective one of the first and second lift cylinders 114 and 116. To aid in determining when the first accumulator control valve 212 and/or the second accumulator control valve 214 actuate, a first cylinder pressure sensor 216 can be arranged to sense a pressure at the inlet 148 of the first lift cylinder 114 and a second cylinder pressure sensor 218 can be arranged to sense a pressure at the inlet 150 of the second lift cylinder 116. Alternatively or additionally, a pressure sensor (not shown) can be arranged on each of the input and output of the first accumulator 201 and the second accumulator 202.

During operation, a material handling vehicle (not shown) including the hydraulic system 200 may encounter a input force to one of the rams 126 and 128. In one non-limiting example, one of the rams 126 and 128 can retract in response to the input force. When the one of the rams 126 and 128 retracts into the respective one of the first and second lift cylinders 114 and 116, the pressure within the respective one of the first and second lift cylinders 114 and 116 can increase. This pressure increase can be sensed by the respective one of the first and second cylinder pressure sensors 216 and 218. When the pressure increased beyond a predetermined value, the respective one of the first and second accumulator control valves 212 and 214 can actuate to the second position to provide pressurized fluid from the respective one of the first and second accumulators 201 and 202 to the respective one of the first and second lift cylinders 114 and 116. The increased pressure provided by the one of the first and second accumulators 201 and 202 can return the one of the first and second lift cylinders 114 and 116 to a predefined pressure state thereby displacing the one of the rams 126 and 128 to counteract the input force. Alternatively or additionally, a respective one of the first control valve 152 and the second control valve 154 can be actuated to the second position to enable fluid flow from the respective one of the first lift cylinder 114 and the second lift cylinder 116 back to the lowering circuit 112. This actuation of the one of the first and second control valves 152 and 154 can cancel out a vacuum that exists between the first lift cylinder 114 and the second lift cylinder 116 to offset the imbalance induced by the input force.

In some non-limiting examples, the selective operation of the first and second accumulator control valves 212 and 214 and/or the first and second control valves 152 and 154 may be selectively actuated based on a stroke position of one or more of the rams 126 and 128. For example, a change is a stroke position of at least one of the rams 126 and 128 beyond a predefined limit may trigger at least one of the first and second accumulator control valves 212 and 214 or at least one or the first and second control valves 152 and 154 to move and provide a corrective input to the first and second lift cylinders 114 and 116. The corrective input may be adding pressure to one of the first and second lift cylinders 114 and 116 via one of the first and second accumulators 201 and 202 and selective movement of one of the first and second accumulator control valves 212 and 214. Alternatively or additionally, the corrective input may be isolating the first and second lift cylinders 114 and 116 from one another. Alternatively or additionally, the corrective input may be connecting one of the first and second lift cylinders 114 and 116 to the lowering circuit 112 via selective movement of one of the first and second control valves 152 and 154.

The hydraulic systems 100 and 200 enable control over positioning of the rams 126 and 128 by controlling the pressure within the first and second lift cylinders 114 and 116. In this way, the hydraulic systems 100 and 200 can provide stabilization of a mast of a material handling vehicle in dynamic and static events. The design of the hydraulic systems 100 and 200 enable the integration of the mast stabilization components into a typical hydraulic system used to raise and lower a mast. In addition, the hydraulic system 200 can be efficient in that small amounts of flow are required from the first and second accumulators 201 and 202 to alter the position of the rams 126 and 128, respectively. In this way, the traditional limitations of accumulators in material handling vehicle requiring them to be large to gain appreciable flow can be overcome. Given the small flow requirements of the first and second accumulators 201 and 202, the first and second accumulators 201 and 202 may be small and, therefore, charged quickly given the large input load from the pump 104. Furthermore, the pressure charging of the first and second accumulators 201 and 202 can be accomplished by the charge line 204 and the selective actuation of the charge control valve 206.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A hydraulic system for mast stabilization on a material handling vehicle, the material handling vehicle including a first lift cylinder and a second lift cylinder each configured to receive fluid from a pump, the hydraulic system comprising:

a first flow limiting device arranged between the pump and the first lift cylinder; and a second flow limiting device arranged between the pump and the second lift cylinder, wherein the first flow limiting device is configured to restrict fluid flow between the first lift cylinder and the second lift cylinder, and the second flow limiting device is configured to restrict fluid flow between the second lift cylinder and the first lift cylinder; and wherein the first flow limiting device and the second flow limiting device are solenoid operated proportional valves moveable to selectively inhibit fluid communication between the first lift cylinder and the second lift cylinder in response to a pressure within a respective one of the first lift cylinder and the second lift cylinder.

2. The hydraulic system of claim 1, wherein the first flow limiting device is in the form of a first control valve and the second flow limiting device is in the form of a second control valve.

3. The hydraulic system of claim 1, further comprising a first accumulator configured to be selectively in fluid communication with the first lift cylinder via a first accumulator control valve, and a second accumulator configured to be selectively in fluid communication with the second lift cylinder via a second accumulator control valve.

4. The hydraulic system of claim 3, wherein the first accumulator control valve is moveable between a first position where fluid communication is inhibited between the first accumulator and the first lift cylinder and a second position where fluid communication is provided between the first accumulator and the first lift cylinder.

5. The hydraulic system of claim 4, wherein the first accumulator control valve is selectively moveable between the first position and the second position in response to a pressure within the first lift cylinder.

6. The hydraulic system of claim 3, wherein the second accumulator control valve is moveable between a first position wherein fluid communication is inhibited between the first accumulator and the second lift cylinder and a second position where fluid communication is provided between the second accumulator and the second lift cylinder.

7. The hydraulic system of claim 6, wherein the second accumulator control valve is selectively moveable between the first position and the second position in response to a pressure within the second lift cylinder.

8. The hydraulic system of claim 3, further comprising a bypass line arranged to provide fluid communication from the first lift cylinder and the second lift cylinder to a reservoir.

9. The hydraulic system of claim 8, where a bypass control valve is arranged on the bypass line and is configured to be selectively moveable between a first position where fluid communication is inhibited from the first and second lift cylinders and the reservoir and a second position where fluid communication is provided from the first and second lift cylinders and the reservoir.

10. The hydraulic system of claim 3, further comprising a charge line arranged to provide fluid communication from the pump to the first accumulator and the second accumulator.

11. The hydraulic system of claim 10, wherein a charge control valve is arranged on the charge line and is configured to be selectively moveable between a first position where fluid communication is inhibited between the pump and the first and second accumulators and a second position where fluid communication is provided between the pump and the first and second accumulators.

12. The hydraulic system of claim 11, wherein a pressure sensor senses a pressure within the first and second accumulators and the charge control valve is selectively moveable between the first position and the second position in response to the pressure sensed by the pressure sensor.

* * * * *